United States Patent [19]

Button

[11] Patent Number: 4,933,975

[45] Date of Patent: Jun. 12, 1990

[54] DYNAMIC LOUDSPEAKER FOR PRODUCING HIGH AUDIO POWER

[75] Inventor: Douglas J. Button, Los Angeles, Calif.

[73] Assignee: Electro-Voice, Inc., Buchanan, Mich.

[21] Appl. No.: 196,438

[22] Filed: May 19, 1988

[51] Int. Cl.[5] ..... H04R 9/04; H04R 9/00; H04R 9/02; H04R 9/06

[52] U.S. Cl. ..... 381/192; 381/193; 381/194; 381/197; 381/199

[58] Field of Search ..... 381/192, 193, 194, 197, 381/199-201; 181/171, 172

[56] References Cited

U.S. PATENT DOCUMENTS

| | | | |
|---|---|---|---|
| 1,759,725 | 5/1930 | Young et al. | 181/171 |
| 1,869,665 | 8/1932 | Chann | 381/194 |
| 1,915,217 | 6/1933 | Crosley et al. | 181/171 |
| 2,038,401 | 4/1936 | Wanderlich | 381/197 |
| 2,775,309 | 12/1956 | Villchur | 381/193 |
| 3,328,537 | 6/1967 | Hecht | 381/194 |
| 3,436,494 | 4/1969 | Bozak | 181/171 |
| 3,991,286 | 11/1976 | Henricksen | 381/194 |
| 4,210,778 | 7/1980 | Sakurai et al. | 381/188 |
| 4,239,943 | 12/1980 | Czerwinski | 381/197 |
| 4,379,952 | 4/1983 | Kaizer et al. | 381/197 |
| 4,387,275 | 6/1983 | Shimada et al. | 381/194 |
| 4,433,214 | 2/1984 | Jasinski | 381/193 |
| 4,508,941 | 4/1985 | Wiggins | 381/197 |
| 4,590,332 | 5/1986 | Delbuck | 381/194 |
| 4,661,973 | 4/1987 | Takahashi | 381/194 |

FOREIGN PATENT DOCUMENTS

| | | | |
|---|---|---|---|
| 667495 | 11/1938 | Fed. Rep. of Germany | 381/193 |
| 2605613 | 9/1976 | Fed. Rep. of Germany . | |
| 821930 | 12/1937 | France | 381/194 |
| 121744 | 5/1948 | Sweden | 381/197 |
| 469197 | 7/1937 | United Kingdom | 381/197 |

OTHER PUBLICATIONS

*The Handbook for Sound Engineers,* Glen Ballon, 1987, pp. 430-431.

*Primary Examiner*—Jin F. Ng
*Assistant Examiner*—Danita R. Byrd
*Attorney, Agent, or Firm*—Burmeister, York, Palmatier & Zummer

[57] ABSTRACT

A loudspeaker with a voice coil reciprocally disposed in a magnetic gap provided with means for conducting heat outwardly from the gap comprising a flat circular web disposal in abuttment with the magnetic structure and extending between a cylindrical collar which confronts the voice coil former to a circular ring integral with the frame of the loudspeaker and including vanes extending from the web between the collar and ring. The voice coil former is limited to axial motion by a pair of spaced flat disks mounted at their centers on the central pole piece normal to the axis of motion and on the coil former at their perimeters.

16 Claims, 3 Drawing Sheets

10
12
14
16
18
20
22
24
26
28
30
32
34
36
38
40
42
44
46
48
50
52
54
56
58
60
62
64
66
68
70
72
74
108
110
112
114
116
126
128
130
132
134
136
138
140
142
144
146
148
150
152
154
158
160
162
164
166

FIG. 3
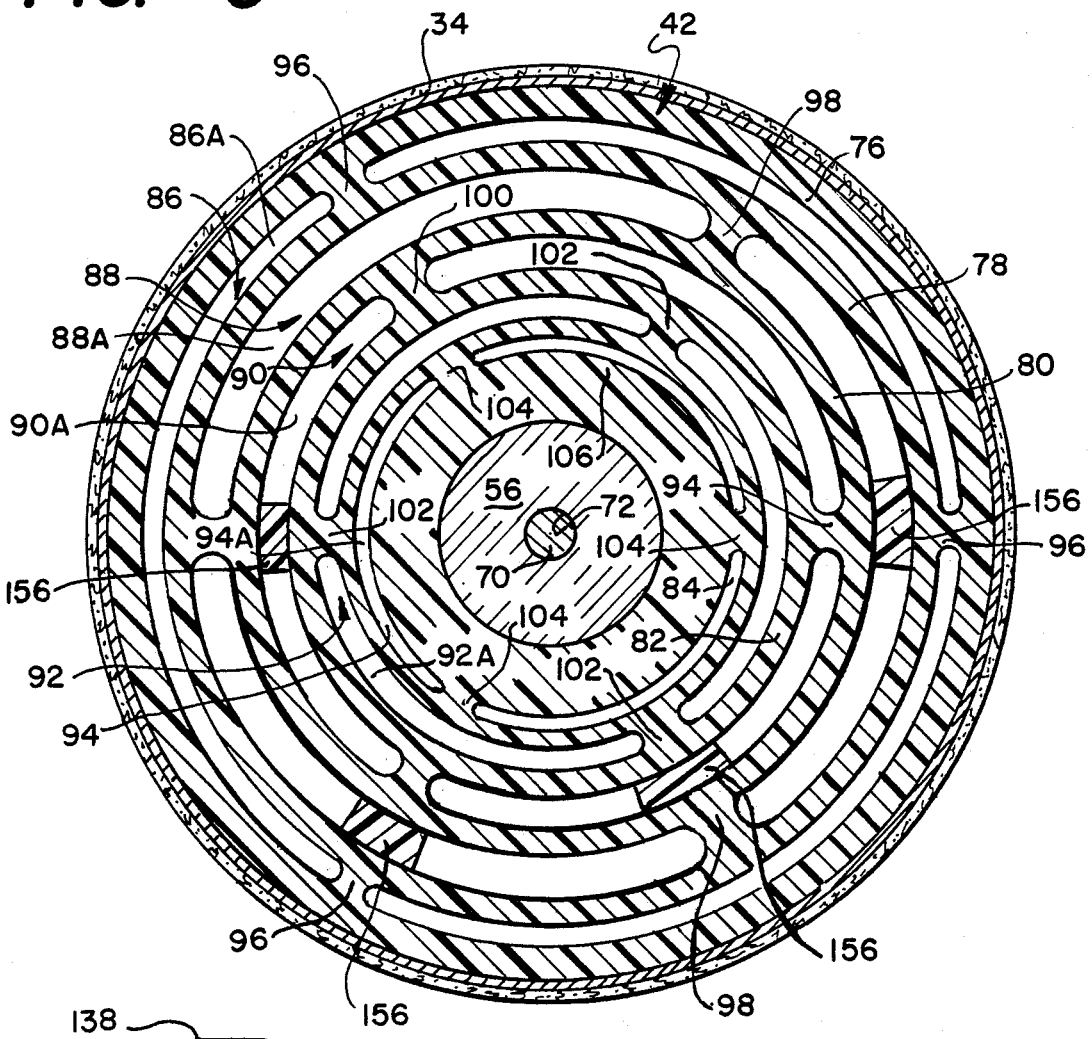
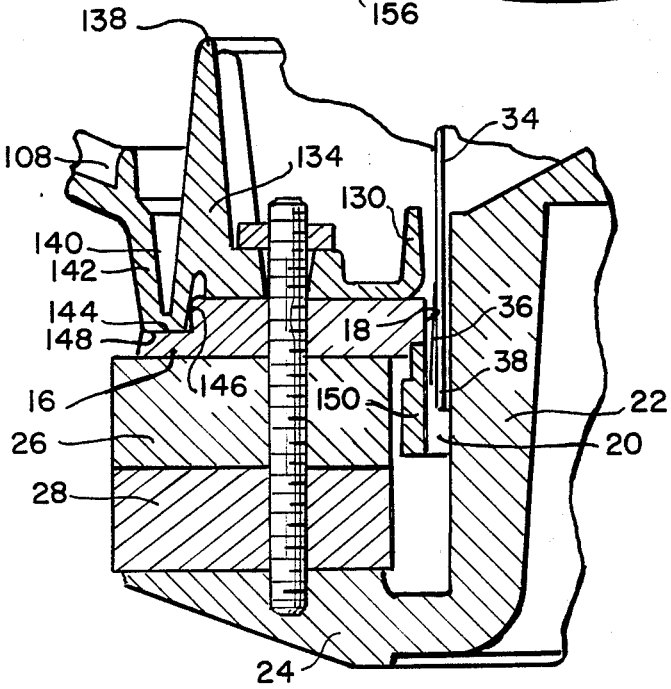
FIG. 5

DYNAMIC LOUDSPEAKER FOR PRODUCING HIGH AUDIO POWER

The present invention relates generally to loudspeakers, and more particularly to dynamic loudspeakers for producing high level sound

BACKGROUND OF INVENTION

Dynamic loudspeakers are generally used to produce audio output from electrical signals, and such dynamic loudspeakers consist of a diaphragm in the shape of a cone driven by a voice coil located in a magnetic field. The factors which influence the performance of conventional dynamic loudspeakers are well-known as indicated by chapter 6 of "Acoustical Engineering" by Harry F. Olson, D. Van Nostrand Company, Inc. 1957.

One of the factors which influences the performance of a dynamic loudspeaker is the uniformity of the magnetic field as seen by the voice coil during its excursion. In practice, the magnetic field is established in a gap between a cylindrical opening in a flat ferromagnetic plate, referred to as a front plate, and a cylindrical ferromagnetic pole piece mounted co-axially within the opening of the plate. The voice coil is mounted on the diaphragm for translation along the axis of the pole piece, and the length of the voice coil relative to the thickness of the plate is a factor in determining the uniformity of the flux experienced by the voice coil during its excursion. To subject the voice coil to uniform flux, the voice coil is often made longer than the magnetic gap, so that approximately the same number of turns of the voice coil are disposed within the magnetic gap regardless of the deflection of the diaphragm.

The use of a voice coil, which is long compared to the thickness of the plate which forms the magnetic gap, however, causes the ends of the voice coil to experience increased temperature operation. The resistance of the voice coil reacts with the current flowing through the voice coil to generate heat uniformly throughout the entire length of the voice coil. Since the voice coil is operating in an air gap, the principal mechanism for heat removal is convection and the principal heat flow from the voice coil is to the portion of the front plate and pole piece which confront the magnetic gap. Heat conduction from the pole piece and front plate to the perimeter of the loudspeaker frame maintains these elements relatively cool, since heat conduction is a much more effective way for heat removal than convection.

The overhanging upper and lower portions of the voice coil are cooled by convection over relatively long pathways unless another mechanism is provided to cool these portions of the voice coil. Heating of the voice coil is undesirable, since it raises the resistance of the voice coil and creates thermal power compression. Long-term heating of the voice coil reduces the overall efficiency of the diaphragm driver which may degrade performance. Also, the ability of the loudspeaker to react to input transients may be degraded resulting in thermal clipping.

Offenlegungsschrift No. 2,605,613 published by the Republic of Germany on Feb. 9, 1976 entitled LAUTSPRECHER describes a loudspeaker construction in which the overhanging portions of the voice coil, both above and below the gap, are cooled by non-magnetic blocks mounted above and below the front plate of the loudspeaker, the blocks extending the outer wall of the gap on both sides of the front plate. The Offenlegungsschrift also describes a cylindrical block mounted on the central pole piece which extends the inner wall of the magnetic gap outwardly from the central pole piece. This constructions shortens the path of convection heat transfer from the upper and lower overhang portions of the voice coil, and provides a conduction path for heat from these portions of the voice coil coupled to the shorter convection path.

Dynamic loudspeakers ultimately depend upon transfer of heat from the voice coil to the ambient atmosphere to limit temperature, and this transfer occurs principally by convection from the frame and magnetic structure of the loudspeaker to the surrounding air. Further, the thermal resistance between the front plate and the frame of the loudspeaker is relatively low because heat is transferred principally by conduction, and transfer of heat from the frame t the surrounding air becomes the ultimate limitation. It is an object of the present invention to improve the cooling which can be achieved for the voice coil over that of prior constructions, and particularly the transfer of heat to the surrounding air.

In all dynamic loudspeakers, it is undesirable to permit the voice coil to scrape against either the inner or outer wall of the magnetic gap, since scraping will deteriorate the voice coil and will produce distortion in the sound output. The conventional construction to maintain the voice coil at a distance from the walls of the gap and cylindrical with the central pole piece is to mount the coil on a coil former or bobbin, which is cemented to the diaphragm, and to utilize a flexible surround at the perimeter of the diaphragm and a spider mounted between the coil former and the frame to restrict movement of the coil former to translation along the central axis of the pole piece. As the power of loudspeakers increases, however, the force exerted on the coil increases, and it is necessary for the coil to be translated over longer and longer distances to reproduce low frequencies. These factors have made it difficult to avoid contact between the voice coil and the walls of the gap, and efforts have been made to ameliorate the undesirable effects of contact between the voice coil and the walls of the gap. U.S. Pat. No. 4,547,632 of Michael Bryson entitled DYNAMIC LOUDSPEAKER seeks to minimize the effects of contact of the voice coil with the walls of the gap by coating the walls of the gap with a plastic material. It is a further object of the present invention to provide a dynamic loudspeaker with a voice coil mounted on a loudspeaker diaphragm and maintained centrally of the magnetic gap by an improved and novel spider mechanism which is suitable for high power use and overcomes these adverse effects.

Efforts have been made to improve the suspension of the voice coil mechanism of a loudspeaker as disclosed in U.S. Pat. No. 4,387,275 of Yasuomi Shimada, Tatsuo Fukuyama, and Toshiyuki Mizutani dated June 7, 1983 and entitled SPEAKER AND SPEAKER SYSTEM. In a specialized type of loudspeaker, two or more spiders are employed between the coil former and the frame or the cone of a loudspeaker. U.S. Pat. No. 4,379,952 of Kaizer, et al. entitled MECHANICAL FILTER FOR AN ELECTRODYNAMIC TRANSDUCER also has an embodiment with two centering disks between the voice coil and the frame in another specialized loudspeaker. The *Handbook for Sound Engineers,* Glen Ballou, Editor, 1987, Howard W. Sams &

Company, illustrates at page 430 a Gauss cone loudspeaker utilizing a double spider between the frame and the coil former. The *Handbook for Sound Engineers, supra,* also discloses a Stroker loudspeaker of Cerwin-Vega in which a spider extends between the coil former and frame, and a second spider-type disk is mounted between a post extending from the pole piece of the loudspeaker and a portion of the diaphragm of the loudspeaker spaced from the coil former.

It is an object of the present invention to provide a loudspeaker with a diaphragm and voice coil mounted on a coil former with a voice coil suspension superior to that of prior loudspeakers, particularly a suspension that permits extended axial travel of the voice coil without scraping of the gap structure.

SUMMARY OF THE INVENTION

The present invention provides an electromagnetic loudspeaker capable of handling power inputs far in excess of those previously impressed upon such loudspeakers by providing improved cooling for the voice coil and an improved voice coil suspension system. The voice coil is mounted on a coil former which is suspended by two spaced disk-shaped spiders on the pole piece of the loudspeaker. In a preferred construction, the disk-shaped spiders are in the form of flat resilient disks having a plurality of rings containing part circular slots disposed between rings of solid material. The coil former is mounted on the perimeter of the disks and the center portion of the disks are mounted in spaced relation on a post extending axially from the cylindrical pole piece. The voice coil has a central axis which is substantially longer than the thickness of the front plate of the loudspeaker, and the voice coil mounting is designed to provide large linear excursions from a rest position for the production of very high energy, low frequency sound of high fidelity. The thermal energy produced by the voice coil is, in part, conducted to the perimeter of the frame by a thermally conducting member mounted on the front plate and having a cylindrical collar extending therefrom confronting the upper end of the voice coil, the member having radial vanes extending outwardly from the collar to conduct heat outwardly from the collar and the front plate of the loudspeaker. In a preferred construction, the member is also provided with a heat sink in the form of a ring of thermal conducting material extending co-axially about the collar at a distance from the collar and communicating thermally with the ends of the vanes opposite the collar.

DESCRIPTION OF THE DRAWINGS

The invention will be more clearly understood from the following specification and drawings, in which:

FIG. 3 is an enlarged fragmentary sectional view taken along the line 3—3 of FIG. 2;

FIG. 5 is a fragmentary sectional view taken along the line 5—5 of FIG. 1.

DETAILED DESCRIPTION OF INVENTION

Figure 1:
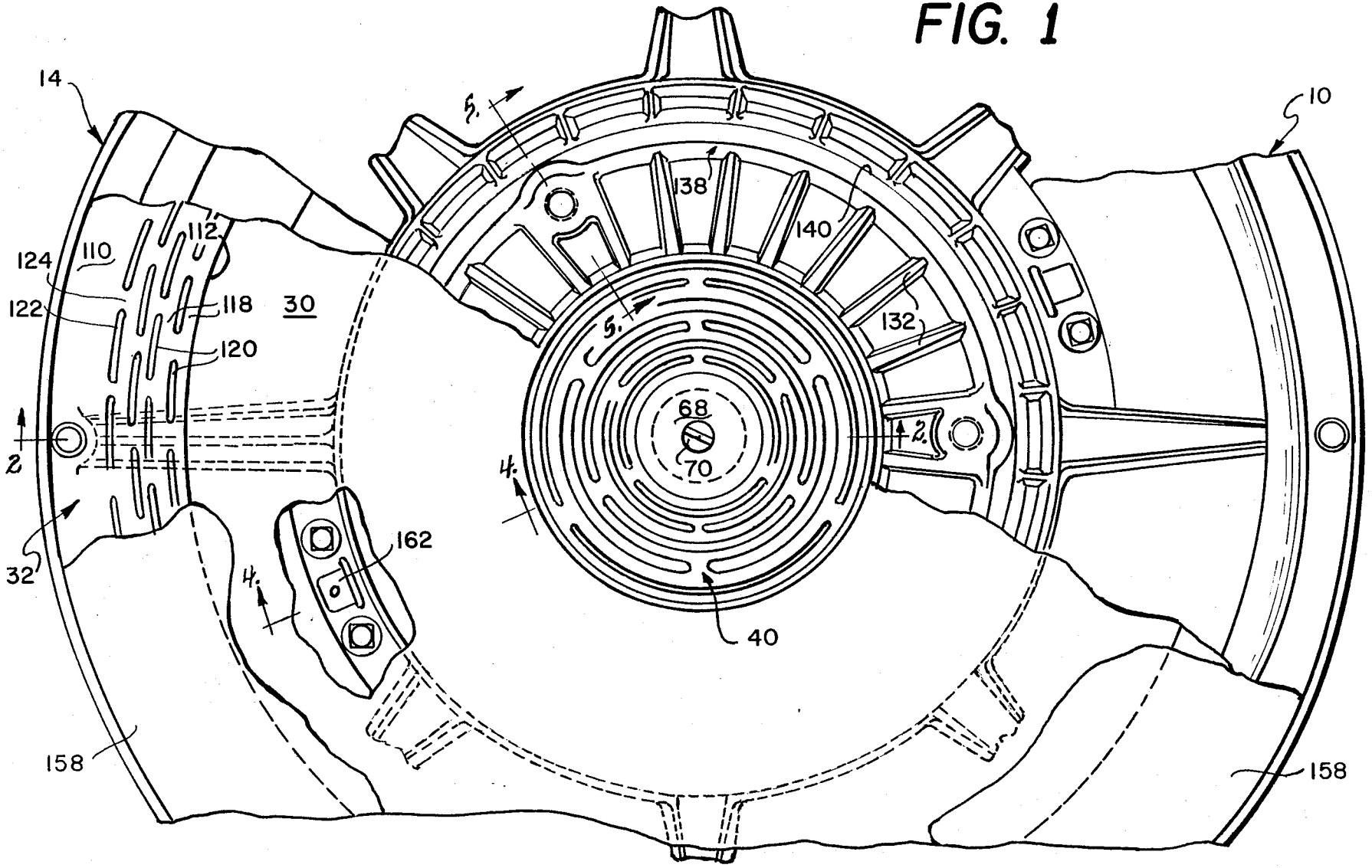
FIG. 1 is a fragmentary plan view of a loudspeaker constructed according to the teachings of the present invention, partly broken away to illustrate underlying portions.
Figures 2, 4:
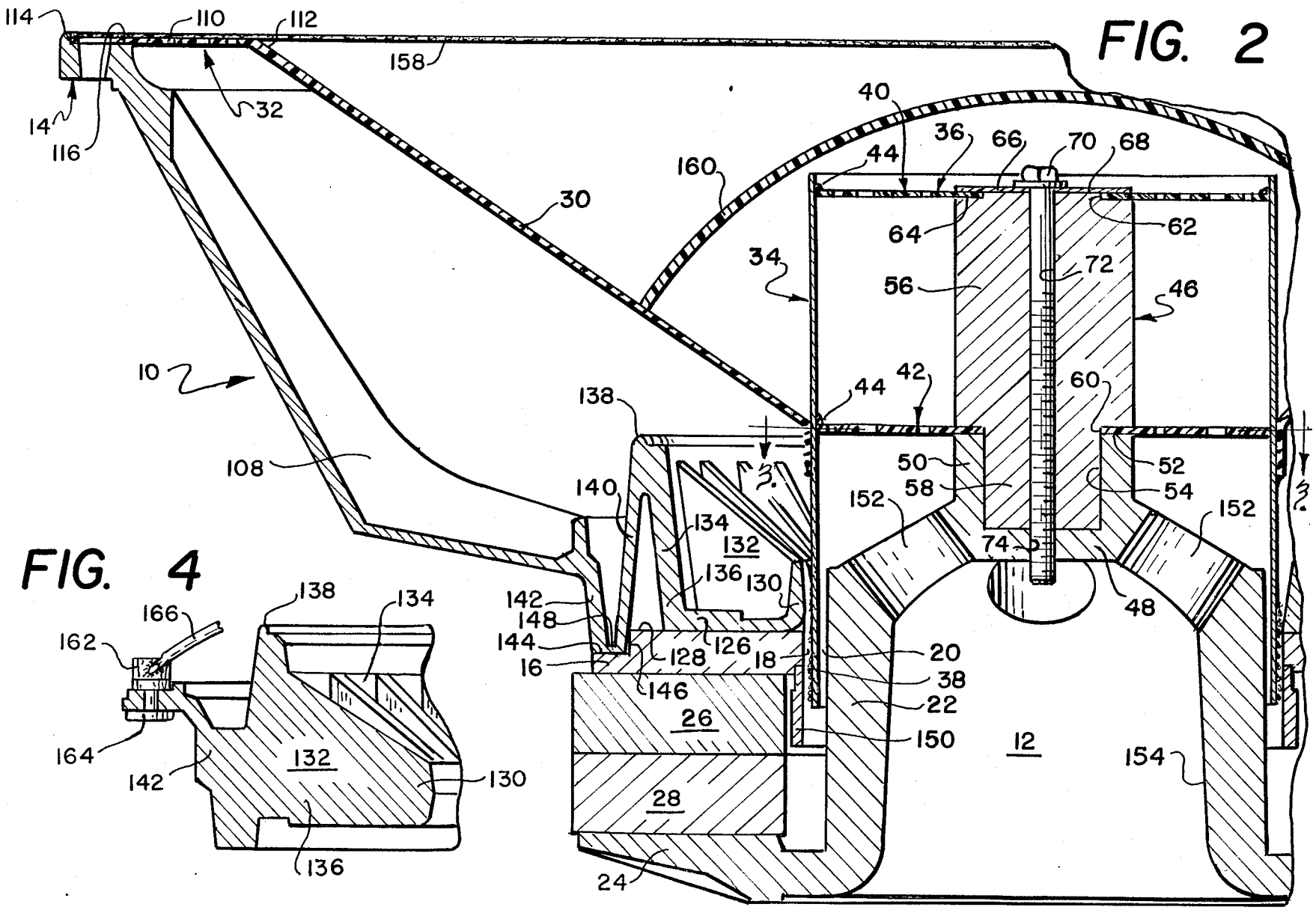
FIG. 2 is a fragmentary sectional view taken along the line 2—2 of FIG. 1.
FIG. 4 is a fragmentary sectional view taken along the line 4—4 of FIG. 1.

As illustrated in FIGS. 1 and 2, the loudspeaker has a frame 10 which is mounted on a driver 12 and extends to a ring portion 14. The driver 12 has a ferromagnetic front plate 16 which is provided with a cylindrical opening 18 which forms one wall of the magnetic gap 20. A ferromagnetic cylindrical pole piece 22 is disposed within the opening 18 and spaced therefrom, and the wall of the cylindrical pole piece 22 forms the other wall of the magnetic gap 20. The cylindrical pole piece 22 is integral with a back plate 24 which extends outwardly from the pole piece, and a pair of ferromagnetic magnet rings 26 and 28 are sandwiched between the front plate 16 and the back plate 24, the magnetic rings 26 and 28 being polarized to add together to provide a magnetic circuit through the pole piece 22, magnetic gap 20 and front plate 16.

The frame 10 and driver 12 form a support structure for a movable cone 30 which is mounted at its outer perimeter on the ring portion 14 of the frame 10 by a compliant surround 32, and is mounted at its inner perimeter on a cylindrical coil former or bobbin 34. The coil former 34 is co-axial with the cylindrical pole piece 22 and extends into and through the magnetic gap 20. The coil former 34 is limited to translation along the axis of the cylindrical pole piece 22 by a compliant mounting 36. The coil former 34 carries a voice coil 38 on its outer cylindrical surface, and the voice coil 38 is centered in the rest position on the front plate 16, and extends outwardly from both sides of the front plate 16.

The compliant mounting means 36 utilizes a pair of spaced parallel disks 40 and 42 which are attached at their perimeters on the coil former 34. In the particular application, a bead 44 of adhesive is utilized between each of the disks 40 and 42 and the inner cylindrical wall of the coil former 34. The disks 40 and 42 are disposed normal to the central axis of the central pole piece 22 and are anchored on the central pole piece 22 in fixed position by a disk-mounting means generally shown at 46. The mounting means 46 utilizes a cap 48 which is integral with and extends outwardly from the end of the pole piece 22 adjacent to the diaphragm 30. The cap 48 has a cylindrical stub 50 which extends outwardly co-axial with the cylindrical surface of the pole piece 22, and the cap terminates in a flat surface 52 normal to the axis of the cylindrical pole piece 22. A recess 54 extends axially from the surface 52, and a post 56 has a cylindrical hub 58 disposed in the recess 54. The post 56 is cylindrical with the same outer diameter as the stub 50, and the disk 42 has a central aperture 60 slidably disposed within the hub 58, the disk 42 being wedged between the post 56 and the surface 52 of the stub 50.

The post 56 has a recess 62 at its end opposite the hub 58 forming a circular flat surface 64 normal to the axis of the post. The disk 40 has a axial aperture 66 disposed within the recess 62, and the disk 40 is in abutment with the surface 64. A washer 68 engages the side of the disk 40 opposite the post 56, and a bolt 70 extends through an axial bore 72 in the post and is anchored in a threaded aperture 74 in the cap 48 of the pole piece 22, thus securely holding the disk 40 between the washer 68 and surface 64 and the disk 42 between the post 56 and surface 52.

The disks 40 and 42 are constructed of a thin sheet of resilient material, such as a resin impregnated fiberglass sold commercially under the designation G-10. The two disks 40 and 42 are identical, and are best illustrated in FIG. 3. The disk 42 has a first plurality of rings of solid material, 76, 78, 80, 82, and 84, and a second plurality of circular bands designated 86, 88, 90, 92 and 94, each ring being separated by a pair of bands. The band 86 has a plurality of slots 86A, the band 88 has a plurality of slots 88A, the band 90 has a plurality of slots 90A, the band 92 has a plurality of slots 92A, and the band 94 has a plurality of slots 94A. Each slot is a segment of a circle, and the slots in each band are disposed on a circle and separated by lands 96, 98, 100, 102 or 104. Accordingly, each of the rings is connected to adjacent rings by a plurality of lands. The ring 76 is connected to the ring 78 by three lands 96, the ring 78 is connected to the ring 80 by three lands 98, the ring 80 is connected to the ring 82 by three lands 100, the ring 82 is connected to the ring 84 by three lands 102, and the ring 84 is connected to the inner ring 106 by three lands 104.

Those lands bridging every other slot are disposed on the same radii of the disk, and hence, the lands 96, 100, and 104 bridging slots 86A, 90A, and 94A are disposed on common radii, and the lands 98 and 102 bridging slots 88A and 92A are on common radii, the latter radii being disposed on the bisectors of the radii referred to above. In effect, the lands 96 form three equally spaced hinges between the rings 76 and 78, and the lands 98 form three equally spaced hinges between the rings 78 and 80. Likewise, the lands 100 form three equally spaced hinges between the rings 80 and 82, the lands 102 form three equally spaced hinges between the rings 82 and 84, and the lands 104 form three equally spaced hinges between the inner ring 106 and the ring 84. As a result, deflection of the disk occurs at the perimeter with respect to the center of the disk. The fact that two disks 40 and 42 are employed, and the disks are anchored at their center on the post 56 and at their perimeter on the coil former 34, assures that the deflection of the coil former will always be on the axis of the cylindrical pole piece 22.

The construction of the compliant mounting 36 for the coil former 34 not only assures translation of the coil former co-axially of the cylindrical pole piece 22, but the use of the disks 40 and 42 provides for longer deflections than conventional constructions. A low frequency speaker requires movement of the voice coil over a relatively long distance, and the particular compliant mounting 36 permits a long throw voice coil to be utilized to produce large sound pressures. In a preferred embodiment disks 40 and 42 are constructed of 1/16th inch thick G-10 sheet material which is commercially available and the suspension thus constructed has a substantially linear deflection with force characteristic over a relatively wide range of deflections.

The ring portion 14 of the frame is mounted to the front plate 16 through arms 108, the arms 108 and ring portion 14 forming a basket to accommodate the diaphragm or cone 30. The surround 32, which extends between the cone 30 and the ring portion 14, may be a conventional corrugated flexible surround, but the surround 32 is preferably constructed in an analogous manner to the compliant mounting means provided for the coil former 34, namely the use of a disk 110. The disk 110 has an axial opening 112, and the diaphragm 30 extends to the inner edge of the disk and is cemented thereto. The disk also has a circular outer perimeter 114, and the outer perimeter rests upon a flat surface 116 of the ring portion 14.

The disk 110 is provided with a plurality of rings 118 of solid material which extend circularly about the opening 112, and the rings 118 are separated by bands 120 which are annular and co-axial with the rings 118. The bands 120 are provided with a plurality of slots 122 in the form of segments of a circle, and the slots 120 are disposed at a common distance from the axis of the band and spaced by lands 124. It will thus be noted that the surround 32 is constructed in the same manner as the compliant mounting 36 for the coil former, except, only a single disk 110 is employed.

The frame 10 includes structure for cooling the voice coil to permit high power operation. The frame 10 is mounted on the front plate 16, and has a web 126 disposed in abutment with the flat surface 128 of the front plate 16, thereby providing good thermal contact between the front plate 16 and the frame 10. A substantially cylindrical collar 130 extends outwardly from the surface 128 co-axial with the pole piece 22, and the collar 130 confronts the coil former 34 and the portion of the coil extending above the surface 128 in the front plate 16. The collar 130 and web 126, and all portions of the frame 10, are constructed of thermally-conducting material, and, therefore, the distance between the collar 130 and the overhanging portion of the voice coil 38 is significantly reduced and the convection path is significantly reduced.

Heat from the collar 130 is conducted outwardly by a plurality of vanes 132 which are in the form of flat plates disposed on radii of the pole piece 22, and the frame is provided with a circular ring 134 which extends outwardly from the web 126 and is disposed at the end of the vanes 132 opposite the collar 130. The ring 134 forms a heat sink with a thermal capacity substantially greater than the thermal capacity of the collar 130. The collar, 130, vanes 132 and ring 134 establish a relatively constant temperature and avoid temperature excursions from momentary power peaks which occur when bass passages requiring high power are reproduced.

The ring 134 has one end 136 which is integral with the web 126, and an opposite end 138 which is integral with a circular wall 140 which extends about the ring 134 and is substantially conical in shape. The wall 140 is connected at its end opposite the ring 134 with the arms 108 through a substantially conical extension or nub 142. Heat is withdrawn from the ring 134 by radiation and convection from the ring and wall 140 and extension 142, as well as conduction through the arms 108 of the frame and radiation and convection therefrom.

The front plate 16 is provided with a recess 144 having shoulder 146 in the form a cylindrical surface coaxial with the pole piece 22, and the wall 140 joins the extension 142 in a region having a flat surface 148 which abuts the surface 144 of the front plate 16. The wall 140 also abuts the surface 146, thereby assuring proper centering of the frame 10 on the magnetic structure and positioning the collar 130 coaxial with the pole piece 12.

The pole piece 22 also extends upwardly of the flat surface 128 of the front plate 16, thereby providing a surface adjacent to the coil former 34 to cool the inside of the overhanging portion of the voice coil 38. A cylindrical non-magnetic member 150 is mounted on the front plate 16 and extends downwardly therefrom t extend the cylindrical opening 18 downwardly, thereby providing cooling for the overhanging portion of the voice coil 38 on the lower side of the front plate 16. The pole piece 22 is also provided with a plurality of apertures 152 in the cap thereof in order to provide for cooling through the disks 40 and 42 and through a cylindrical opening 154 extending into the pole piece 22 from the back plate 24 and communicating with the apertures 152.

At some frequencies, the length of the slots 86A, 88A, 90A, 92A and 94A in the disks 40 and 42, or the slots 122 in the disk 110 may be such that resonances are established in the disks, thereby creating an unwanted sound. Resonances may avoided by damping the disk with small plugs 156 of compliant material, such as a soft plastic or rubber. Further, the compliance of the disks 40, 42 and 110 may be altered by changing the length of the lands between rigs (the width of the slots), and the displacement may be progressively increased from one edge of the disk to the other by increasing the length of the lands from the one edge to the other. When used as a surround, such as the disk 110, it is desirable to prevent the passage of air through the disk, since the loudspeaker may be used in conjunction with an enclosure. For this purpose, a sheet of compliant fabric 158, which is air-tight, may be applied to one or both surfaces of the disk 110, and the fabric will both dampen resonances in the disk and eliminate the passage of air through the disk.

For aesthetic reasons, and to prevent dust and dirt from entering the voice coil region of the magnetic gap 20, a dust cover 160 is mounted on the diaphragm 30 and extends about the coil former 34. The dust cover 160 is in the form of a dome, and may be cemented to the diaphragm 30.

The inventor has provided a loudspeaker which is useful at very high power and very low frequencies. Powers of the order of 1,000 watts in RMS current have been applied to 15 and 18 inch loudspeakers constructed in the manner here set forth, and such speakers may be used at frequencies as low as 20 cycles per second. To achieve such operation, the electrical connections to the voice coil must be capable of handling power levels of that magnitude, and terminals 162 for this purpose are mounted on electrically insulating connectors 164 adjacent to the extension 142. A conductor fragmentarily shown at 166 is connected to the terminal 162 and extends over the wall 134 to the voice coil 38 to provide this electrical connection.

From the foregoing preferred embodiment of the present invention, those skilled in the art will devise many constructions other than that set forth herein within the contemplated scope of the invention. Further, those skilled in the art will develop uses and applications for the present invention beyond those here set forth. It is therefore intended that the scope of the present invention be not limited by the foregoing specification, but rather only by the appended claims.

The invention claimed is:

1. A loudspeaker comprising, in combination: a frame having a basket with a circular portion; a diaphragm; means mounted on the diaphragm and the circular portion of the basket for mounting the diaphragm for translation along an axis normal to the plane of the circular portion; a magnetic structure mounted to the frame having a ferromagnetic plate with first and second spaced opposed surfaces, said plate having a cylindrical opening extending therethrough between the first and second surfaces, and a ferromagnetic cylindrical pole piece of smaller diameter than the cylindrical opening disposed co-axially within the opening to form a annular gap between the pole piece and the plate, the magnetic structure producing a magnetic field with lines of force extending radially across the annular gap; a cylindrical voice coil with a central axis having an inner diameter greater than the diameter of the cylindrical pole piece and an outer diameter less than the diameter of the cylindrical opening in the plate, the length of said coil along the central axis thereof being greater than the distance between the first and second surfaces of the plate; means for mounting the voice coil on the diaphragm for translation along the axis of translation of the diaphragm, said mounting means including means for suspending the voice coil co-axially within the annular gap with one end portion of the coil extending outwardly of the first surface of the plate; and means for cooling the voice coil comprising a member of non-magnetic thermally conducting material disposed in abutment with the first surface of the plate, said member having a collar with a cylindrical orifice with a diameter approximately equal to the diameter of the opening in the plate and disposed co-axially with the opening in the plate, said member having a web extending outwardly from the collar in abutment with the plate and a plurality of spaced vanes disposed in planes traversing the central axis of the voice coil and extending outwardly from the collar and the web.

2. A loudspeaker comprising the combination of claim 1 wherein the cooling means member includes a ring disposed co-axially about the collar and spaced from the collar, the ring extending outwardly from the web and the vanes extending from the collar to the ring, said ring having a thermal capacity substantially greater than the thermal capacity of the collar.

3. A loudspeaker comprising the combination of claim 2 wherein the cooling means member is integral with the frame.

4. A loudspeaker comprising the combination of claim 1 wherein the basket of the frame has a hub and a plurality of spaced arms extending from the hub to the circular portion of the frame, the frame having a circular wall disposed between the hub and the ring.

5. A loudspeaker comprising the combination of claim 4 wherein the ring has a first and a second end and the hub has a first and a second end, the web extending to the second end of the ring and the arms extend to the first end of the hub, the second end of the hub being remote from the circular portion of the basket, and the wall extending from the second end of the hub to the first end of the ring.

6. A loudspeaker comprising the combination of claim 5 wherein the first surface of the plate of the magnetic structure has a flat region disposed about the cylindrical opening, and the web has a first flat surface confronting and abutting the fist surface of the plate and an opposed second surface, the vanes extending outwardly from the second surface of the web.

7. A loudspeaker comprising the combination of claim 6 wherein the second end of the hub is disposed on the plate, the hub and the wall passing through the plane of the first surface of the plate, and the plate having a shoulder extending from the first surface of the plate in abutment with the hub and wall.

8. A loudspeaker comprising the combination of claim 7 wherein the hub, wall and ring are circular.

9. A loudspeaker comprising the combination of claim 1 wherein the cylindrical pole piece extends outwardly from the plane of the first surface of the plate, the coil former being partially disposed between the collar and the pole piece.

10. A loudspeaker comprising the combination of claim 9 wherein the pole piece has an axial channel and openings at opposite ends of the channel.

11. A loudspeaker comprising the combination of claim 1 wherein the means for mounting the voice coil on the diaphragm comprises an elongated coil former having a cylindrical outer surface spaced from a cylinder inner surface, the coil former having spaced opposite ends, the voice coil being disposed on one of the surfaces of the coil former adjacent to one end thereof and the coil former extending outwardly from the first surface of the plate, and at least two circular disks having central portions disposed bout the centers thereof and extending from the central portions to the perimeters thereof, said disks being mounted at their perimeters on the coil former in parallel spaced planes normal to the axis of elongation of the coil former, each of said disks being flat and constructed of resilient material and having a plurality of spaced concentric ring portions disposed between the central portion and the perimeter thereof, adjacent concentric ring portions being separated by a circular slot disposed in the disk concentric with the ring portions, adjacent ring portions being interconnected by a plurality of spaced coupling lands extending across the circular slot between the adjacent concentric ring portions, and mounting means mounted on the pole piece and engaging the center portion of each of the disks, said mounting means maintaining said center at a fixed distance from each other and from the plate of the magnetic structure.

12. A loudspeaker comprising the combination of claim 11 wherein each concentric ring portion on a disk is interconnected with the adjacent concentric ring portions on opposite sides thereof by the same plurality of equally spaced lands, the lands between said ring portion and one of said adjacent ring portions being disposed on a first group of radii of said disk, and the lands between the said concentric ring portion and the other of said adjacent ring portions being disposed on a second group of radii of said disk, the radii of the first group being disposed centrally between radii of the second group.

13. A loudspeaker comprising the combination of claim 12 wherein the lands and ring portions are integral parts of the disk.

14. A loudspeaker comprising the combination of claim 12 wherein the disk is constructed of plastic.

15. A loudspeaker comprising, in combination, a frame having a portion with a flat surface and a first opening therein adapted to accommodate a diaphragm, a diaphragm, means mounted on the diaphragm and the portion of the frame for mounting the diaphragm for translation of the diaphragm along an axis normal to the plane of the flat surface, a magnetic structure mounted to the frame having an opening and a pole piece disposed within the opening to define a magnetic gap, a coil former mounted on the diaphragm for translation along the axis of the diaphragm, a voice coil mounted on the coil former, the voice coil and a portion of the coil former being disposed within the magnetic gap and the coil former extending outwardly from the magnetic gap, and means for suspending the coil former in the magnetic gap comprising a first flat sheet of flexible resilient material having a perimeter conforming to and mounted on the coil former, the first sheet having a first central portion mounted on the pole piece and being disposed normal to the axis of translation, said first sheet having a plurality of circular first bands and a plurality of first ring portions extending about the first central portion, each first band being disposed between first ring portions, each of the first bands having a plurality of long, narrow slots extending along the first band separated from each other by first lands, and each of the first ring portions being of continuous material, a second flat sheet of flexible resilient material having a perimeter conforming to the coil former mounted on the coil former parallel to and spaced from the first flat sheet, the second sheet having a second central portion mounted on the pole piece, said second sheet having a plurality of continuous circular second bands and a plurality of second ring portions extending about the second central portion, each of the second ring portions being a narrow closed strip, and each second band being disposed between second ring portions, each of the second bands having a plurality of long narrow slots extending along the second band separated from each other by lands.

16. A loudspeaker comprising the combination of claim 15 wherein a post is mounted on the pole piece and extends along the axis of translation within the coil former, and the central portions of the first and second sheets are mounted on the post.

* * * * *

UNITED STATES PATENT AND TRADEMARK OFFICE

CERTIFICATE OF CORRECTION

PATENT NO. : 4,933,975

DATED : June 12, 1990

INVENTOR(S) : Douglas J. Button

It is certified that error appears in the above-identified patent and that said Letters Patent is hereby corrected as shown below:

Column 2, line 5, delete "constructions" and insert ---construction---;
line 18, delete "t" and insert ---to---.

Column 6, line 64, delete "t" and insert ---to---.

Column 8, line 53, delete "fist" and insert ---first---.

Column 9, line 14, delete "bout" and insert ---about---.

Signed and Sealed this

Tenth Day of September, 1991

*Attest:*

HARRY F. MANBECK, JR.

*Attesting Officer*

*Commissioner of Patents and Trademarks*